US007731052B2

(12) United States Patent
Rappaport

(10) Patent No.: US 7,731,052 B2
(45) Date of Patent: Jun. 8, 2010

(54) CAMOUFLAGING AND INSULATING COVER FOR COMPRESSED GAS TANKS

(76) Inventor: David H. Rappaport, 139 W. Gray Ct. #316, Spokane, WA (US) 99220

( * ) Notice: Subject to any disclaimer, the term of this patent is extended or adjusted under 35 U.S.C. 154(b) by 847 days.

(21) Appl. No.: 11/636,767

(22) Filed: Dec. 12, 2006

(65) Prior Publication Data

US 2007/0151641 A1 Jul. 5, 2007

Related U.S. Application Data

(60) Provisional application No. 60/755,373, filed on Jan. 3, 2006.

(51) Int. Cl.
*B65D 25/34* (2006.01)

(52) U.S. Cl. ..... 220/592.24; 220/694

(58) Field of Classification Search ..... 220/592.24, 220/694, 694.1, 724, 890; 150/154, 901
See application file for complete search history.

(56) References Cited

U.S. PATENT DOCUMENTS

| | | | | |
|---|---|---|---|---|
| 1,869,756 | A | 8/1932 | Kinard | |
| 3,616,959 | A * | 11/1971 | Remesy et al. | 220/647 |
| 5,809,650 | A | 9/1998 | Reese et al. | |
| 5,865,223 | A | 2/1999 | Cornford | |
| 6,012,411 | A | 1/2000 | Hochbrueckner | |
| 6,102,230 | A | 8/2000 | Gould | |
| 6,123,187 | A | 9/2000 | Bartels | |
| 6,508,282 | B2 | 1/2003 | Garofalo et al. | |
| 6,532,907 | B1 | 3/2003 | Harrison | |
| 7,117,908 | B1 * | 10/2006 | Coron | 150/154 |
| 2007/0125789 | A1 * | 6/2007 | Abdo | 220/694 |

* cited by examiner

*Primary Examiner*—Stephen Castellano
(74) *Attorney, Agent, or Firm*—Lukins & Annis, PS

(57) ABSTRACT

A flexible configurationally conformable camouflaging and insulating cover for an exposed compressed gas tank having a colored semi-opaque camouflaging exterior covering and an inner insulating layer supported spacedly adjacent the tank by plural spacers. Air passage spaces between the tank and the inner insulating layer formed by the spacers allows circulation of air therethrough to cool the tank and dissipate any heat absorbed by the cover and the tank.

18 Claims, 3 Drawing Sheets

CAMOUFLAGING AND INSULATING COVER FOR COMPRESSED GAS TANKS

RELATED APPLICATIONS

This application claims the benefit of U.S. Provisional Application No. 60/755,373 filed on Jan. 3, 2006.

BACKGROUND OF INVENTION

1. Field of Invention

This invention relates to protective covers, and more particularly to a camouflaging and insulating flexible protective cover for compressed gas tanks.

2. Background and Description of Prior Art

Petroleum gas, such as propane, is a common heating fuel for residences, shops, swimming pools and the like because of its efficiency, environmental friendliness and low cost. In locales where gaseous heating fuel cannot be supplied via underground pipes, it is stored on site in large aboveground tanks that are regularly filled by vendors using commercial vehicles.

Residential and commercial propane tanks are large commonly having 120, 250, 500, 1,000 and 1,500 gallon capacities and are typically elongate cylinders with hemispherical ends supported above a supporting surface on short legs. A valve assembly, commonly on a top portion of the cylinder and protected by a sturdy hinged cover, regulates the flow of pressurized propane from the tank to a spacedly adjacent propane appliance such as a furnace.

Almost universally, propane tanks are painted with a coating having a highly reflective white color to minimize heat absorption which leads to thermal expansion of the propane and increased pressure in the tank. Further, pressure relief valves that open and vent propane to the atmosphere when the pressure in the tank exceeds a safety threshold (typically 250 PSI) are required on all large residential and commercial propane tanks by Fire Codes.

Heat absorption, due to high ambient temperatures and exposure to direct sunlight, is a common cause of venting. To reduce the frequency of venting, industry practice limits filling of propane tanks to 80% of maximum capacity so that volume expansion caused by temperature increases can be accommodated without exceeding the safety threshold of the pressure relief valve.

The shape, the size and the highly reflective white color tend to make propane tanks unsightly and aesthetically unappealing and these features are perceived as drawbacks by customers. These drawbacks are exacerbated because propane tanks must be located in close proximity to the appliances and structures using the propane due to propane plumbing requirements and due to the need for vehicular access to the tank for refilling.

The unsightliness of propane tanks causes many people to cover or otherwise camouflage the tanks despite Fire Codes and Regulations that may prohibit such covers and camouflaging. Unfortunately, many of the methods, devices and apparatus used to cover and camouflage tanks increase heat absorption, the likelihood of venting, the risk of fires and the risk of explosions. Further, many of the methods, devices and apparatus used to cover and camouflage tanks are permanent or semi-permanent and difficult to remove which hinders inspection of the tank seams by service personnel during refilling. Industry practice encourages all service personnel to visually inspect all tank seams for corrosion, rust and evidence of any problems every time a tank is filled and/or serviced.

A cover is needed for exposed residential and commercial size propane tanks that camouflages and obscures the tank and blends with the surroundings, while simultaneously minimizing heat absorption and heat transfer from the cover to the tank to reduce the likelihood of venting.

The prior art discloses various apparatus and systems for covering and insulating small barbecue size propane tanks, and at least one rigid picket fence-like structure attachable to a large upright propane tank to screen the tank from view. However, the known prior art does not provide a method, device or an apparatus that overcomes the obtrusiveness and unsightliness of large white cylindrical propane tanks proximate to places where people tend to gather, such as swimming pool areas. The known prior art does not provide a means to camouflage such tanks or cause the tank to blend into its surroundings. Further, the known prior art does not provide a means to cover and camouflage such tanks while simultaneously reducing the likelihood of venting by reducing heat absorption.

The present invention seeks to overcome these and other drawbacks to exposed propane tanks and to known propane tank covers by providing a multi-layer flexible configurationally conformable propane tank cover that uses colors and patterns to obscure, camouflage and conceal otherwise obtrusive propane tanks. The present invention provides an inner insulating layer between a camouflaging exterior cover and the propane tank that minimizes heat transfer from the cover to the tank and further provides for air conducting spaces, through which air may move by means of confection or otherwise, between the inner insulating layer and the tank.

My invention does not reside in any one of the identified features individually but rather in the synergistic combination of all of its structures, which give rise to the functions necessarily flowing therefrom as hereinafter claimed.

SUMMARY

My camouflaging and insulating cover for compressed gas tanks generally provides a flexible configurationally conformable cover having a medial rectilinear body portion with hemispherical shaped end portions fastened thereto, the cover having a semi-opaque camouflaging exterior layer, an inner insulating layer and a valve cap cover. A plurality of spacers form air passage spaces between the inner insulating layer and the propane tank.

In providing such an apparatus it is:

a principal object to provide a flexible configurationally conformable cover for an exposed compressed gas tank that camouflages and obscures the tank so that it is less obtrusive and less noticeable in its surroundings.

a further object to provide such a cover that has a plurality of air passage spaces, between the tank and the cover, through which air may pass by means of convection or otherwise.

a further object to provide such a cover that has insulating air about the tank and under the cover to reduce heat transfer from the cover to the tank.

a further object to provide such a cover wherein vented propane will not accumulate under the cover and about the tank forming a fire hazard.

a further object to provide such a cover that has air vents and an open bottom for passage of air and propane therethrough.

a further object to provide such a cover that employs colors and patterns to camouflage and obscure the tank.

a further object to provide such a cover that reduces heat transfer and thermal expansion that may lead to venting caused by increased internal pressure.

a further object to provide such a cover that is easily removable during filling and servicing for inspection of tank seams.

a further object to provide such a cover that is a color other than highly reflective white.

a still further object to provide such a cover that is of new and novel design, of rugged and durable nature, of simple and economic manufacture and one that is otherwise well suited to the uses and purposes for which it is intended.

Other and further objects of my invention will appear from the following specification and accompanying drawings which form a part hereof. In carrying out the objects of my invention it is to be understood that its structures and features are susceptible to change in design and arrangement with only one preferred and practical embodiment of the best known mode being illustrated in the accompanying drawings and specified as is required.

BRIEF DESCRIPTIONS OF DRAWINGS

In the accompanying drawings which form a part hereof and wherein like numbers refer to similar parts throughout:

DESCRIPTION OF PREFERRED EMBODIMENT

Figure 1:
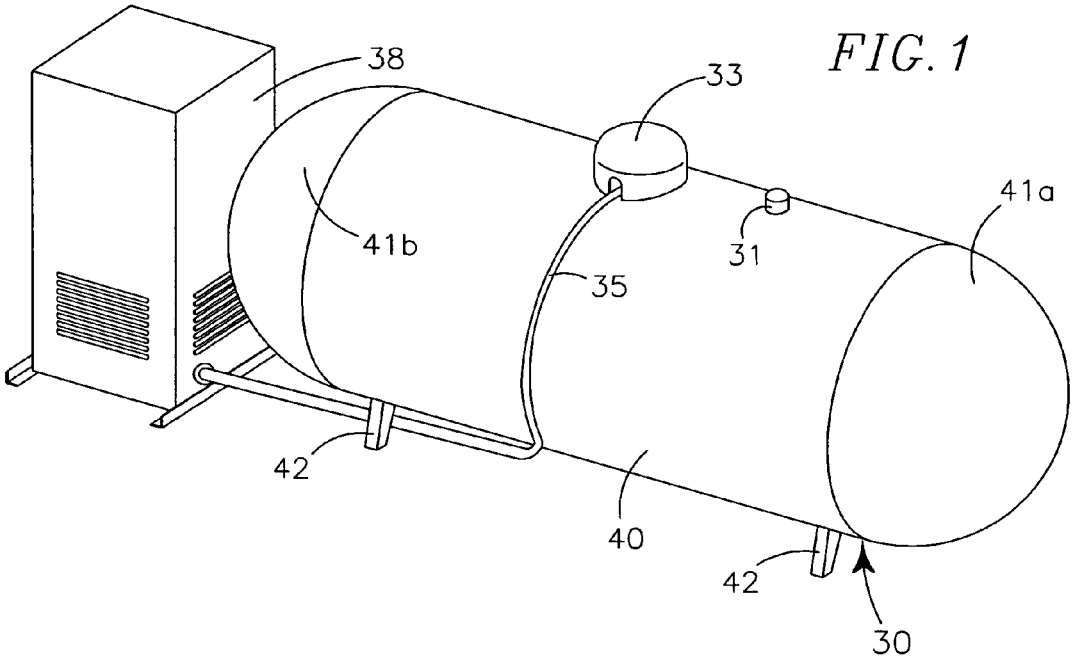
FIG. 1 is an isometric side and top view of a typical residential/commercial propane tank installation showing a horizontal elongate propane tank and associated external propane appliance with plumbing connections extending therebetween.

My camouflaging and insulating cover for compressed gas tank 30 generally provides a flexible configurationally conforming camouflaging cover 10 having a camouflaging exterior cover 12, an inner insulating layer 13 and a valve cover cap 20.

As generically shown in FIG. 1, the compressed gas tank 30 upon which my cover 10 operates is an elongate horizontal cylinder 40 having structurally attached bulbous end portions 41*a*, 41*b* and supported above a supporting surface, such as a concrete pad (not shown), by plural spacedly arrayed legs 42 that depend from a lower portion of the cylinder 40. A radially protruding hinged valve assembly cover 33, at a medial upper portion of the cylinder 40, protects valves (not shown) and plumbing connections 35 that are in pneumatic communication with an external petroleum gas appliance 38, such as a furnace. A pressure relief valve 31 that communicates with a chamber (not shown) defined by the tank 30 is required on all large residential and commercial propane tanks by fire codes to allow propane therein to vent to the atmosphere if the pressure of the propane in tank 30 exceeds the safety threshold, typically 250 PSI, of the pressure relief valve 31.

Figure 2:
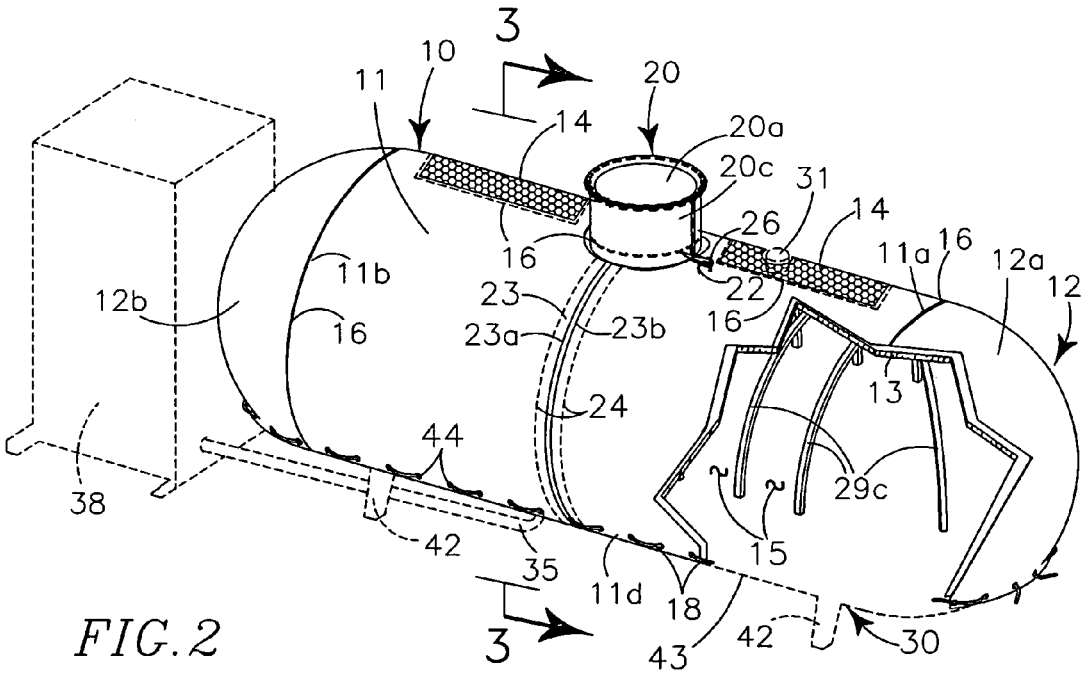
FIG. 2 is a partially cutaway view of the instant cover installed on the propane tank of FIG. 1 showing circumferentially extending elongate spacer ribs supporting the insulating inner layer and camouflaging exterior cover about the propane tank, the elongate mesh covered air vents and the valve cover cap.

The camouflaging exterior cover 12 is formed of a generally rectilinear medial body portion 11 having opposing elongate end portions 11*a*, 11*b*, opposing side edge portions 11*c*, 11*d* and orifice 21 at a generally medial portion through which the valve assembly cover 33 protrudes. A generally hemispherical shaped end portion 12*a*, 12*b* is fastened to each elongate end portion 11*a*, 11*b* by stitching 16 so that the camouflaging exterior cover 12 forms an elongate half cylinder with hemispherical end portions 12*a*, 12*b* and an elongate open bottom 43 between the opposing side edges 11*c*, and 11*d*. The opposing side edge portions 11*c*, 11*d* and bottom edge portions of the hemispherical end portions 12*a*, 12*b* carry known fastening means thereon so that the edges of the open bottom 43 may be releasably gathered together to secure the exterior cover 12 about a lower portion of the tank 30. The fastening means may include plural spacedly arrayed grommets 44 through which a draw cord 18 may be laced and drawn (FIG. 2), or a draw cord 18 carried in a hem channel 17 (FIG. 5) formed by folding an edge portion of each side edge 11*c*, 11*d* and bottom edge portions of each hemispherical end portion 12*a*, 12*b* over onto itself and securing the folded over portion in place by stitching 16. A belly strap (not shown) may also be used to releasably secure the side edges 11*c*, 11*d* together below the tank 30.

A vertical side seam 23 in the medial body portion 11 (FIG. 2) extends from the orifice 21 to one side edge portion 11*c* to allow positioning of the exterior cover 12 beneath plumbing connections 35, such as a pipe, originating beneath the valve assembly cover 33 and communicating with the external petroleum gas appliance 38. Elongate strips of hook and loop fastener 24, such as Velcro®, are carried on opposing edges 23*a*, 23*b* of the vertical side seam 23 to releasably fasten the opposing edges 23*a*, 23*b* together beneath the plumbing connections 35.

Elongate rectilinear air vents 14 are defined in the exterior cover 12 between orifice 21 and each elongate end portion 11*a*, 11*b*, and medially between the side edge portions 11*c*, 11*d*. Each air vent 14 is covered with a mesh type fabric defining a plurality of holes therein for minimally restrictive movement of air therethrough. The mesh type fabric covering is fastened to the camouflaging exterior cover 12 by stitching 16.

The camouflaging exterior cover 12 is preferably formed of a colored semi-opaque gas permeable fabric that has preferably been treated with a known water repellant, flame retardant and ultra-violet light protectant to increase the useful life of the fabric, to prevent self-sustaining combustion and to prevent fading. Preferably the color, and paternation if any, of the exterior cover 12 blends into the surrounding foliage so that the tank 30 is camouflaged, obscured and less obvious in its surroundings. In the preferred embodiment the camouflaging exterior cover 12 is formed of one hundred percent polyester spun-bound non-woven fabric having a weight of 1.5 ounces per square foot and manufactured by Schott International, Inc. of New Jersey, USA. In a second preferred embodiment the camouflaging exterior cover 12 is formed of 100% polyester woven mesh-type fabric defining a plurality of generally regularly arrayed holes therethrough having a weight of 1.6 ounces per square foot and manufactured by Jason Mills, Inc. of New Jersey, USA.

The inner insulating layer 13 is preferably formed of expanded closed cell foam, such as low-density polyethylene, that has been treated with flame retardant. The inner insulating layer 13 may be attached to the camouflaging exterior cover 12, such as by stitching (not shown) extending therethrough, or may remain separate from the camouflaging exterior cover 12 and be installed separately therefrom. The "closed cell" nature of the foam forms smooth outer surfaces that minimizes friction and resistance as air passes thereover, thereunder and thereacross.

Figure 3:
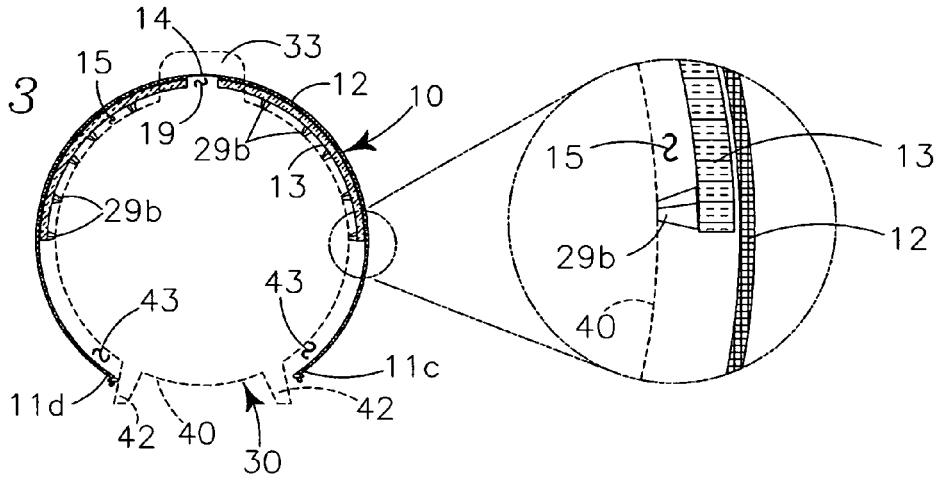
FIG. 3 is a cross sectional view of a second embodiment of the instant cover taken on line similar to line 3-3 of FIG. 2 with an accompanying enlarged view to more clearly show a spacer supporting the inner insulating layer and camouflaging exterior cover outwardly adjacent the propane tank with air conducting space therebetween.
Figure 5:
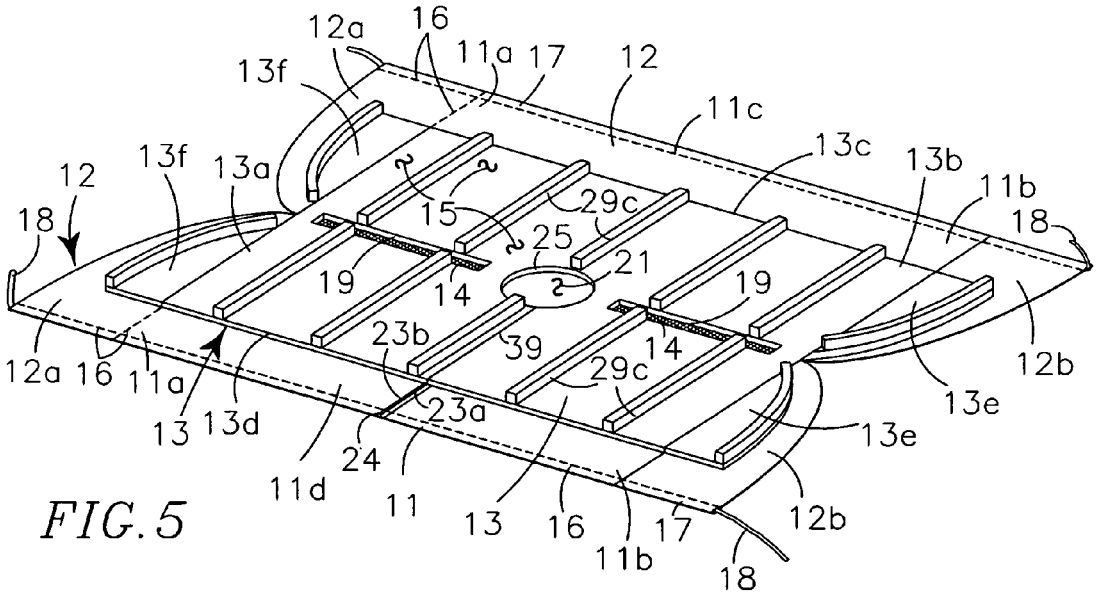
FIG. 5 is a flattened isometric view of the underside of the instant cover showing one embodiment of the inner insulating layer having elongate spacer ribs to support the inner insulating layer and camouflaging exterior cover about the propane tank and defining air passage spaces therebetween.

As shown in FIG. 5, the inner insulating layer 13 has a generally rectilinear configuration with opposed elongate end portions 13*a*, 13*b*, opposed side edge portions 13*c*, 13*d*, and defines a medial orifice 25 and a side seam 39 extending between the medial orifice 25 and side edge 13*d*. Sector shaped portions 13*e*, 13*f* extend from each elongate end portion 13*a*, 13*b* to provide an insulating layer inside the hemispherical end portions 12*a*, 12*b* of the camouflaging exterior cover 12. The inner insulating layer 13 does not have the same side edge 13*c* to side edge 13*d* dimensions as the exterior cover 12 but rather extends only to a position spacedly adjacent the side edges 11*c*, 11*d*. The inner insulating layer 13 must cover the upper surface of the tank cylinder 40 but need not completely cover the entire circumference of the cylinder 40. (See FIG. 3). An elongate rectilinear through hole 19 is defined between orifice 25 and each elongate end portion 13*a*, 13*b* and medially between the side edges 13*c*, 13*d*. Each elongate rectilinear through hole 19 communicates with the air vents 14 defined in the camouflaging exterior cover 12 for passage of air therethrough.

Figure 6:
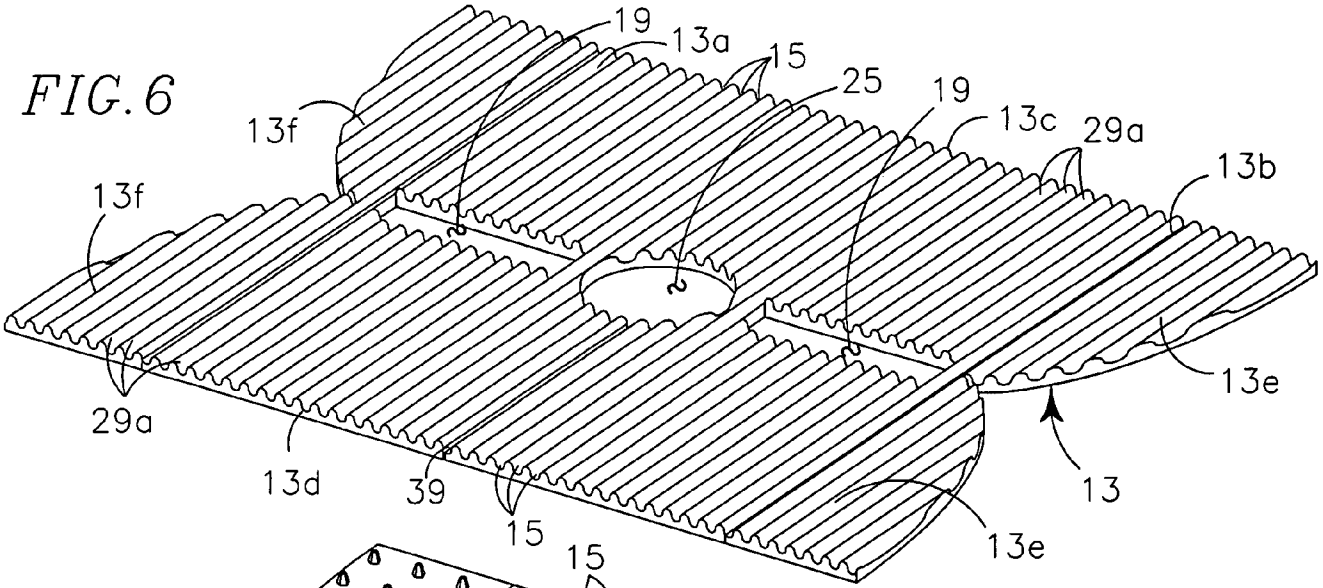
FIG. 6 is a flattened isometric view of the underside of a second embodiment of the inner insulating layer having plural spaced apart parallel ridges forming spacers to support the inner insulating layer and camouflaging exterior cover about the propane tank and defining air passage spaces therebetween.
Figure 7:
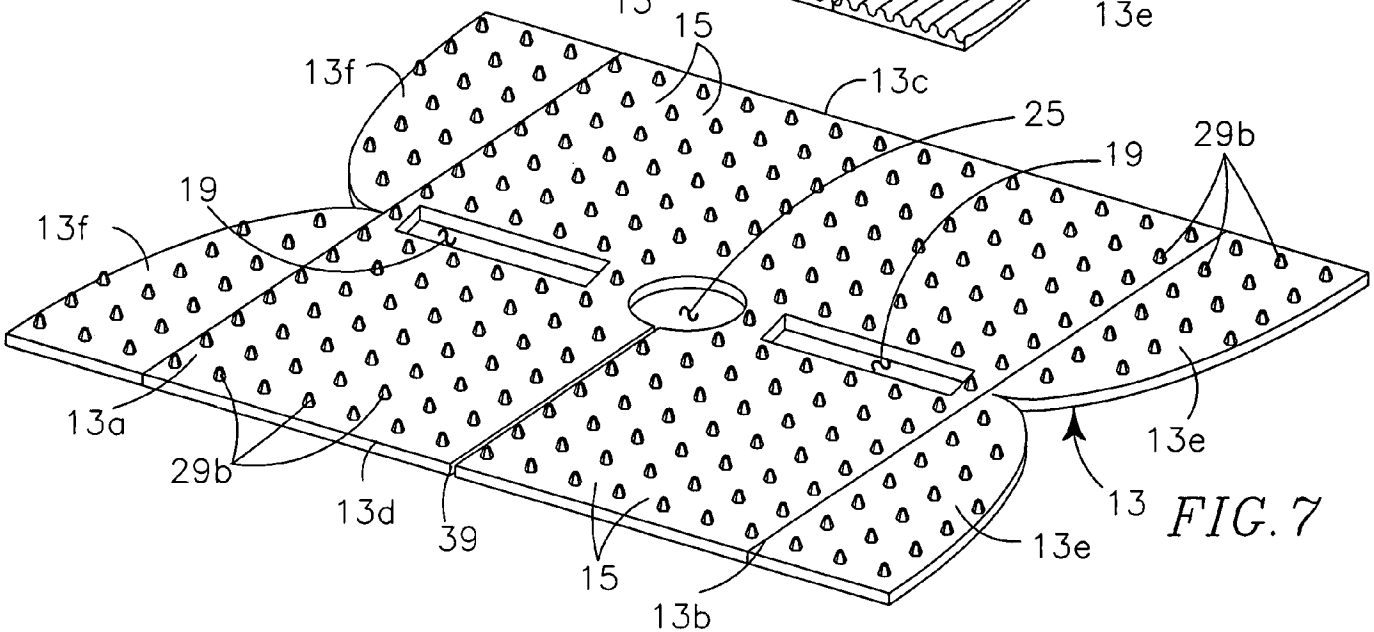
FIG. 7 is a flattened isometric view similar to FIG. 6 of a third embodiment of the inner insulating layer having a plurality of spacedly arrayed protuberances forming spacers to support the inner insulating layer and camouflaging exterior cover about the propane tank and defining air passage spaces therebetween.

Plural spacers 29 support the inner insulating layer 13 and the camouflaging exterior cover 12 spacedly outwardly adjacent the tank 30 and collectively define a plurality of air passage spaces 15 about the tank 30 under the inner insulating layer 13 for passage of air therethrough by convection or otherwise. The spacers 29 are preferably incorporated directly into the inner insulating layer 13 and may take the form of plural spaced parallel protruding ridges 29*a* (FIG. 6) or a plurality of spacedly arrayed protuberances 29*b* (FIG. 7) having an "egg carton" configuration. In another preferred embodiment, the spacers 29 may be separable elongate ribs 29*c* (FIG. 5) that support the inner insulating layer 13 spacedly adjacent the tank 30 and allow passage of air therebetween. The air passage spaces 15 communicate with the side edge portions 13*c*, 13*d* of the inner insulating layer 13 and with the elongate through holes 19. Air within the air passage spaces 15 absorbs heat from the tank 30 and responsively expands becoming less dense. The heated less dense air moves upwardly through the air passage spaces 15 by means of convection or otherwise and exits through the elongate through holes 19 and air vents 14 defined in the upper portion of the cover 10. As the heated less dense air exits the cover 10 cooler air is drawn through the open bottom portion 43 and into the air passage spaces 15 at the side edge portions 13*c*, 13*d* of the inner insulating layer 13. Movement of the air along the circumferential surface of the tank 30 provides cooling. The air passage spaces 15 also provide a path for any propane that has collected under the cover 10 to pass downwardly along the circumference of the tank 30 and exit out the open bottom 43 of the cover 10 reducing fire risks.

Figure 4:
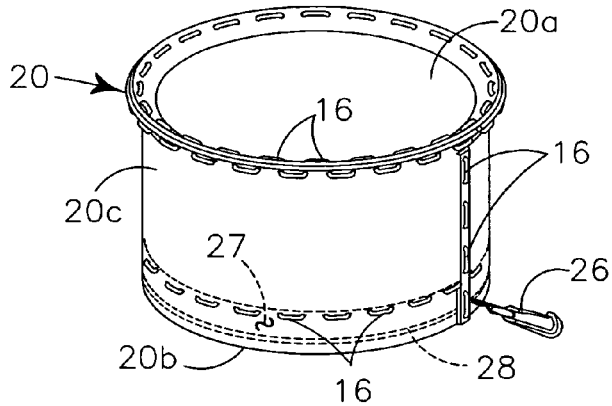
FIG. 4 is an enlarged isometric top and side view of the valve cover cap.

As shown in FIG. 4, the valve cover cap 20 is formed of the same semi-opaque gas permeable fabric used for the camouflaging exterior cover 12 and is configured into a truncated barrel shape having a circumferentially extending side portion 20*c*, a closed top 20*a* and an open bottom 20*b* that are interconnected by stitching 16. A hem channel 27 is formed in a lower edge portion of the circumferentially extending side portion 20*c* around the open bottom 20*b* by folding the lower edge of the side portion 20*c* over onto itself and securing the folded over portion by stitching 16. A draw cord 28 is carried in the hem channel 27 so that the open bottom 20*b* may be drawn about the valve assembly cover 33 to releasably secure the valve cover cap 20 in place. A connecting means 26, such as a releasable snap connector, carried adjacent the open bottom 20*b* is releasably fastenable to a loop 22 adjacent the orifice 21 in the exterior cover 12 to prevent accidental detachment and loss of the valve cover cap 20.

Testing of my camouflaging and insulating cover 10 for compressed gas tanks showed the following:

Example 1

Three 120 gallon residential/commercial size horizontal elongate propane tanks 30, manufactured by Trinity Industries, Inc. in 2004, were placed in an outside test area at Northern Energy Propane Co. in Casa Grande Ariz. The tanks 30 were positioned for exposure to direct sunlight and to avoid any shading during the test. Each tank 30 was filled with liquefied propane to 70 percent capacity.

A first tank 30, identified for purposes of this test as "un-insulated", was covered with an olive green colored camouflaging exterior cover 12 formed of 1.5 oz. spun bound non-woven polyester fabric. The "un-insulated" cover 10 did not have an inner insulating layer 13 between the camouflaging exterior cover 12 and the tank 30. The cover 10 rested directly upon the tank 30.

A second tank 30, identified for purposes of this test as "solid", was covered with a similar olive green colored camouflaging exterior cover 12 formed of 1.5 oz. spun bound non-woven polyester fabric. A one inch thick inner insulating layer 13 of closed cell polyethylene foam was positioned on the tank 30 between the camouflaging exterior cover 12 and the tank 30. The inner insulating layer 13 on the "solid" test tank 30 was rectilinear in cross section with sector shaped end portions 13*e*, 13*f* but did not have any spacers 29 nor did it define any air passage spaces 15 between the inner insulating layer 13 and the tank 30.

A third tank 30, identified for purposes of this test as "air flow", was covered with a similar olive green colored camouflaging exterior cover 12 formed of 1.5 oz. spun bound non-woven polyester fabric. A one inch thick inner insulating layer 13 of closed cell polyethylene foam was positioned on the tank 30 between the camouflaging exterior cover 12 and the tank 30. The inner insulating layer 13 on the "air flow" test tank 30 defined plural spaced apart parallel ridges 29*a* forming spacers 29 extending from side edge 13*c* to side edge 13*d* across the inner insulating layer 13 and defining a plurality of air passage spaces 15 between the spacers 29*a*.

Ambient temperatures were taken and recorded, and the internal tank pressures were measured and recorded, at 5:00 pm local time each day.

The testing provided the following results:

| DATE | AMBIENT TEMP AT 5:00 PM LOCAL TIME | UNINSULATED | SOLID | AIR FLOW |
|---|---|---|---|---|
| Apr. 17, 2006 | 94° F. | 239 PSI | 207 PSI | 182 PSI |
| Apr. 18, 2006 | 94° F. | 243 PSI | 209 PSI | 183 PSI |
| Apr. 19, 2006 | 92° F. | 234 PSI | 205 PSI | 180 PSI |
| Apr. 20, 2006 | 96° F. | 245 PSI | 210 PSI | 189 PSI |
| Apr. 21, 2006 | 97° F. | 248 PSI | 217 PSI | 194 PSI |

Having described the structure of my camouflaging and insulating cover for compressed gas tanks, its installation and operation may be understood.

The inner insulating layer 13 is positioned on a dorsal surface of the of the tank cylinder 40 with the valve assembly cover 33 protruding through the medial orifice 25 and the elongate rectilinear through holes 19 on the dorsal surface between the valve assembly cover 33 and each hemispherical end portion 41*a*, 41*b*. The side seam 39 is opened and closed as necessary to accommodate any propane plumbing connections 35. If necessary a hole is cut into the inner insulating layer 13 to allow passage of the pressure relief valve 31 therethrough.

After the inner insulating layer 13 is installed on the tank 30, the camouflaging exterior cover 12 is installed. The vertical side seam 23 is opened by disengaging the hook and loop fastener strips 24 carried on the opposing edges 23*a*, 23*b* of the seam 23, and the draw cord 18 carried in the hem channel 17 is released so that the open bottom 43 may be expanded to its dimensional limits. The cover 10 is placed over and about the tank 30 so that the valve assembly cover 33 extends through orifice 21, the hem channel 17 carrying the draw cord 18 is adjacent the bottom portion of the tank 30 and the air vents 14 are on the dorsal portion of the cylinder 40 and communicate with the rectilinear through holes 19 of the inner insulating layer 13. After the cover 10 has been correctly positioned about the tank 30, the opposing edges 23*a*, 23*b* of the vertical side seam 23 are positioned under any protruding plumbing connections 35 extending from the valve assembly cover 33 and the vertical side seam 23 is closed by reattaching the cooperating portions of the hook and loop fastener strips 24. If necessary, a hole is cut into the camouflaging exterior cover 12 at the appropriate location to allow passage of the pressure relief valve 31 therethrough.

The draw cord 18 carried in the hem channel 17 around the open bottom 43 is drawn gathering the open bottom 43 around and about the lower portion of the tank 30 and depending legs 42. The draw cord 18 is secured with a knot, or similar position securing means, to positionally maintain the cover 10 on and about the tank 30.

The valve cover cap 20 is positioned over and about the valve assembly cover 33 and the draw cord 28 carried in the hem channel 27 is drawn gathering the open bottom portion 20*b* of the valve cover cap 20 about the valve assembly cover 33. The connecting means 26 is fastened to the loop 22 to ensure the valve cover cap 20 is not inadvertently detached or lost.

The foregoing description of my invention is necessarily of a detailed nature so that a specific embodiment of a best mode may be set forth as is required, but it is to be understood that various modifications of details, and rearrangement, substitution and multiplication of parts may be resorted to without departing from its spirit, essence or scope.

I claim:

1. A flexible cover for an exposed horizontal cylindrical pressurized gas tank having hemispherical ends, a upwardly protruding valve cover in a top portion and a support structure for support on an underlying surface, the cover comprising in combination:

an exterior cover of gas permeable flexible fabric having, a rectilinear medial body portion with opposing side edge portions, opposing elongate end portions, a medial orifice for passage of the tank valve cover therethrough, and at least one air vent between the medial orifice and each elongate end portion, the side edge portions depending downwardly over the top and sides of the tank spacedly distant from the underlying surface supporting the tank, end portions having upper semicircular portions and lower rectilinear portions interconnected to each elongate end portion, the lower rectilinear portions depending downwardly over the hemispherical ends of the tank spacedly distant from the underlying surface supporting the tank, an open bottom defined by the side edge portions of the body and lower edges of the end portions having a closing means carried by the side edge portions of the body and the bottom edges of the end portions for gathering the lower edges of the cover about the bottom portion of the tank;

an insulating inner layer between the exterior cover and the tank having, side edge portions spacedly adjacent the side edge portions of the exterior cover and sector shaped end portions extending into the semicircular portions of the end portions, a medial through orifice communicating with the medial orifice of the exterior cover, elongate through holes communicating with the air vents defined in the exterior cover, and plural spacers for supporting the inner insulating layer spacedly adjacent the tank forming air passage spaces therebetween communicating with the side edge portions and the elongate orifices; and a valve cover cap having a closed top, a circumferentially extending side portion and an open bottom releasably fastenable over and about the tank valve cover.

2. The cover of claim 1 wherein: the exterior cover is polyester.

3. The cover of claim 1 wherein: the exterior cover has color and paternation that camouflages the cover and covered tank and causes the cover and covered tank to be less visually obvious in the tank surroundings.

4. The cover of claim 1 further comprising: mesh fabric covering over the air vents defined in the rectilinear medial body portion of the exterior cover for passage of air and gas therethrough.

5. The cover of claim 1 wherein: the fastening means about the open bottom is plural spacedly arrayed grommets carrying a draw cord threaded therethrough.

6. The cover of claim 1 wherein: the fastening means about the open bottom is a hem channel formed into the lower side edge portions and the bottom edges of the end portions, the hem channel carrying a draw cord therein.

7. The cover of claim 1 further comprising: a side seam defined in the exterior cover extending from the medial orifice to one side edge portion, opposing edges of the exterior cover side seam carrying releasable fastening means to fasten the edges of the side seam together beneath any compressed gas plumbing connections, and a side seam defined in the inner insulating layer extending from the medial through orifice to one side edge portion to accommodate the compressed gas connections.

8. The cover of claim 1 wherein: the exterior cover is treated with ultra violet light protectant.

9. The cover of claim 1 wherein: the exterior cover is treated with flame retardant.

10. The cover of claim 1 wherein: the exterior cover is treated with water repellant.

11. The cover of claim 1 wherein: the exterior cover and the inner insulating layer are fastened together.

12. The cover of claim 1 wherein: the inner insulating layer is formed of expanded foam.

13. The cover of claim 1 wherein: the inner insulating layer is formed of expanded polyethylene foam.

14. The cover of claim 1 wherein: the inner insulating layer is treated with flame retardant to inhibit self sustaining combustion.

15. The cover of claim 1 wherein: the inner insulating layer defines plural spaced apart parallel ridges forming the spacers, the spacers defining the air passage spaces therebetween.

16. The cover of claim 1 wherein: the inner insulating layer defines plural spacedly arrayed protuberances forming the spacers, the spacers defining the air passage spaces therebetween.

17. The cover of claim 1 wherein: the spacers are elongate ribs between the inner insulating layer and the tank, the spacers defining the air passage spaces therebetween.

18. A flexible cover for an exposed horizontal cylindrical compressed gas tank having hemispherical ends, a radially upwardly protruding valve cover in a top portion and a support structure for support on an underlying surface, the cover comprising in combination:

a camouflaging exterior cover of colored semi-opaque gas permeable polyester fabric treated with a flame retardant to prevent self sustaining combustion, a ultraviolet light protectant to prevent fading and a water repellant to increase useful life, the exterior cover having, a rectilinear medial body portion with opposing side edge portions, opposing elongate end portions, a medial orifice for passage of the tank valve cover therethrough, and a mesh fabric covered air vent between the medial orifice and each elongate end portion, the side edge portions depending downwardly over the top and sides of the tank spacedly distant from the underlying surface supporting the tank, similar opposed end portions having upper semicircular portions and lower rectilinear portions interconnected to each elongate end portion by stitching, the lower rectilinear portions depending downwardly over the hemispherical ends of the tank spacedly distant from the underlying surface supporting the tank, an open bottom defined by the side edge portions of the body and lower edges of the end portions, a hem channel formed into the side edge portions of the body and lower edges of the end portions, the hem channel carrying a draw cord therein for gathering the edges of the exterior cover about the bottom portion of the tank, and a side seam extending from the medial orifice to one side edge portion, opposing edges of the exterior cover side seam carrying releasable fastening means to fasten the edges of the side seam together beneath any compressed gas plumbing connections;

an insulating inner layer of expanded polyethylene foam between the tank and the camouflaging exterior cover and fastened to the exterior cover, the inner insulating layer having, side edge portions spacedly adjacent the side edge portions of the camouflaging exterior cover and sector shaped end portions extending into the semicircular portions of the opposed end portions, a medial through orifice communicating with the medial orifice of the camouflaging exterior cover and elongate through holes communicating with the mesh fabric covered air vents defined in the camouflaging exterior cover, a side seam extending from the medial through orifice to one side edge portion to accommodate the compressed gas connections, and plural spaced apart parallel ridges forming spacers supporting the inner insulating layer spacedly adjacent the tank and forming plural air passage spaces between the ridges, the air passage spaces communicating with the side edge portions and the elongate through orifices; and a valve cover cap having a closed top, a circumferentially extending side portion and an open bottom releasably fastenable over and about the tank valve cover.

* * * * *